United States Patent [19]

Fehrer

[11] Patent Number: 4,583,267

[45] Date of Patent: Apr. 22, 1986

[54] APPARATUS FOR MAKING A FIBROUS WEB

[76] Inventor: Ernst Fehrer, Auf der Gugl 28, A-4020 Linz, Austria

[21] Appl. No.: 752,307

[22] Filed: Jul. 5, 1985

[30] Foreign Application Priority Data

| | | | |
|---|---|---|---|
| Jul. 18, 1984 | [AT] | Austria | 2316/84 |
| Sep. 11, 1984 | [AT] | Austria | 2903/84 |
| Feb. 19, 1985 | [AT] | Austria | 482/85 |

[51] Int. Cl.[4] ..... D01G 15/26

[52] U.S. Cl. ..... 19/99; 19/145.7; 19/302

[58] Field of Search ..... 19/99, 145.7, 302

[56] References Cited

U.S. PATENT DOCUMENTS

| | | | |
|---|---|---|---|
| 3,511,625 | 5/1970 | Pitt | 19/302 X |
| 4,531,262 | 7/1985 | Reiche | 19/145.5 |
| 4,534,086 | 8/1985 | Fehrer | 19/99 |

FOREIGN PATENT DOCUMENTS

| | | | |
|---|---|---|---|
| 2935325 | 3/1981 | Fed. Rep. of Germany | 19/302 |
| 49-13951 | 4/1974 | Japan | 19/302 |
| 0052453 | 5/1965 | Poland | 19/302 |
| 1175315 | 12/1969 | United Kingdom | 19/302 |

*Primary Examiner*—Louis K. Rimrodt
*Attorney, Agent, or Firm*—Kurt Kelman

[57] ABSTRACT

Apparatus for making a fibrous web comprises a plurality of carding drums (3, 4, 5, 6), which closely succeed each other in the direction of travel of the feed web and rotate in the same sense. An air-permeable collecting surface is provided, on which the fibers of the feed web are deposited which fly from the carding drums (3, 4, 5, 6). Each carding drum (4, 5, 6) which succeeds another (3, 4, 5) in the direction of travel of the feed web constitutes a worker roller associated with the preceding carding drum. In order to increase the permissible speed of travel of the feed web, an additional worker roller (20) and a clearer roller (21) are associated with each carding drum (3, 4, 5, 6) on that side thereof which is remote from the collecting surface (7).

6 Claims, 2 Drawing Figures

APPARATUS FOR MAKING A FIBROUS WEB

BACKGROUND OF THE INVENTION

1. Field of the Invention

This invention relates to apparatus for making a fibrous web comprising a feeder for receiving a feed web, a plurality of serrated carding drums rotating in the same sense at a surface speed which permits the fibers on the drums to fly from the latter under centrifugal force, and an air-permeable collecting surface, which is continually moved and from which air is sucked, and wherein fibers of the preliminary web fly from the carding drums in respective partial streams, which impinge on the collecting surface at points spaced apart in the direction of travel of the collecting surface, the carding drums are arranged one behind the other in the direction of movement of the feed web and are closely spaced apart, and each carding drum which succeeds another in the direction of travel of the feed web constitutes a worker roller associated with the preceding carding drum.

2. Description of the Prior Art

Because in apparatus of the kind described the carding drums closely succeed each other, each succeeding carding drum can act like a worker roller to comb the fibrous material which is delivered by the preceding carding drum so that the combed-out fibers are thrown off onto the collecting surface immediately after they have been combed out. This will result in an adequate opening of the feed web and will permit a division of the feed web into a plurality of partial streams of fibers in a simple manner because each succeeding carding drum effects an additional combing operation, which provides fibrous material for at least one additional partial stream. The partial stream of fibers which fly from each carding drum may have a low fiber density even if the throughput rate of fibrous material through the apparatus is relatively high. A highly uniform web can be obtained owing to that low fiber density of the fibrous streams and to the fact that the fibers are deposited on the collecting surface in a plurality of layers. But in spite of the high throughput rate which is permissible, the opening capacity of the carding drums is restricted so that the speed of travel of the feed web cannot be increased as highly as may be desired.

SUMMARY OF THE INVENTION

It is an object of the invention to improve apparatus of the kind described first hereinbefore by the provision of simple means which permit a further increase of the speed of travel of the feed web and of the throughput rate of the fibrous material.

This object is accomplished in accordance with the invention in that each of the closely succeeding carding drums has associated with it an additional worker roller and a clearer roller, which are disposed adjacent to that half of the periphery of the drum that is remote from the collecting surface.

The additional worker roller and the clearer roller assist the opening of the feed web adjacent to each of the carding drums because part of the fibrous material covering each carding drum is combed out by the associated additional worker roller and when it has been combed out is delivered to the same carding drum by the clearer roller. By that combing operation the opening capacity of each carding drum is increased and the stream of fibers conveyed by the carding drums is increased and the stream of fibers conveyed by the carding drums is rendered more uniform. Any irregularities in the distribution of the fibers will be equalized by the combing operation so that fibers which have been combed out are returned in a more uniform distribution to the stream of fibers on the same carding drum. For this reason the feed web can be opened more uniformly and can be thrown in corresponding partial streams onto the collecting surface even though the feed web may travel at a higher speed.

To permit a uniform deposition of the thrown-off fibers on the collecting surface, the carding drums are covered toward the collecting surface by a covering which defines discharge passages. These discharge passages will restrict air movements, which might disturb a uniform deposition of the fibers. But the discharge passages cannot entirely preclude the disturbing influences of moving air. In order to inhibit such disturbing air streams, the discharge passages may be defined adjacent to the collecting surface by a guide wall, which is disposed on the side on which the collecting surface approaches the discharge passage, which guide wall serves to guide the previously formed web layer, and by a roller rolling on the web layer on that side on which the collecting surface departs from the discharge passage. The guide wall and the roller rolling on the web layer seal the discharge passage from the spaces between that passage and the adjacent discharge passage so that the air streams in the discharge passages can no longer be adversely affected by air stream components which are parallel to the collecting surface. The roller disposed on that side of each discharge passage on which the collecting surface departs is preferably freely rotatably mounted and rotates in such a direction that the roller moves adjacent to the discharge passage in the same direction as the air flow. If such roller were disposed on that side of the discharge passage on which the latter is approached by the collecting surface, the roller would move adjacent to the discharge passage opposite to the direction of air flow so that disturbances might arise. For this reason only a guide wall is provided on that side which is approached by the collecting surface and the previously formed web layer must pass between the guide wall and the collecting surface.

To ensure an adequate sealing of the discharge passages by the guide walls for the previously applied web layer and to ensure also that the web layer can pass freely through the gap between the guide wall and the collecting surface, the guide wall and the collecting surface may define between them an entrance gap for the previously deposited web layer, which entrance gap tapers in the direction of movement of the collecting surface. The tapering entrance gap results in a precompaction of the web layer so that the discharge passage can properly be sealed and a subsequent dislocation of the webs of the web layer is opposed. If the guide wall is resiliently urged against the collecting surface, the compaction can be controlled by a control of the pressure force applied. Besides, webs differing in thickness can then be made without an alteration of the apparatus.

In order to eliminate an exertion of disturbing influences by the walls of the discharge passage on the fibers flying adjacent to the walls toward the collecting surface, a further feature of the invention resides in that a suction nozzle directed toward the discharge passage is disposed under the collecting surface in the region between the two walls of each discharge passage and said nozzle has an inlet opening which is laterally spaced from both walls of the discharge passage within the region of the mouth of the discharge passage. That suction nozzle ensures that a suction stream flowing at a distance from the walls defining the discharge passage will be produced at least adjacent to the mouth of the discharge passage so that individual fibers entrained toward the collecting surface in such a stream of entraining air will not move close to the walls of the discharge passage so that such fibers will not be affected by any disturbing influences of said walls.

Whereas the suction nozzle confines the entraining air stream in the central region of each discharge passage, that confinement must not result in a generation of air vortices by which the individual fibers previously deposited on the collection surface would be dislocated outside the suction zone of the suction nozzle. For this reason a vacuum is preferably applied to the collecting surface on that side which is remote from the discharge passages also outside the suction nozzle, at least adjacent to the mouth of each discharge passage, so that the deposited fibers will be retained on the collecting surface. But such vacuum must not produce in the discharge passages a suction stream which would adversely affect the desired confinement of the entraining air stream. For this reason that vacuum must be properly restricted. To permit an adaptation to existing conditions, the vacuum should be adjustable. This can be achieved in a simple manner by gate valves provided in the suction passages.

In order to ensure an undisturbed deposition of the fibers on the collecting surface, the inclination of the tooth faces and the distribution of the teeth of the carding drums should be so selected that a confined jet of fibers is thrown from each carding drum approximately at right angles to the collecting surface. Whereas the teeth of the carding drums are identical, it may be desirable to provide the worker rollers, particularly those which are associated with the last carding drums in the direction of travel of the feed web, with teeth having faces which are inclined by a larger angle from the radial direction and/or to arrange said teeth with a smaller spacing than those of the carding drums so that the formation of an adequate fibrous layer on the worker rollers will be ensured even if only a small fibrous covering is provided on the associated carding drums.

DETAILED DESCRIPTION OF THE PREFERRED EMBODIMENT

Figure 1:
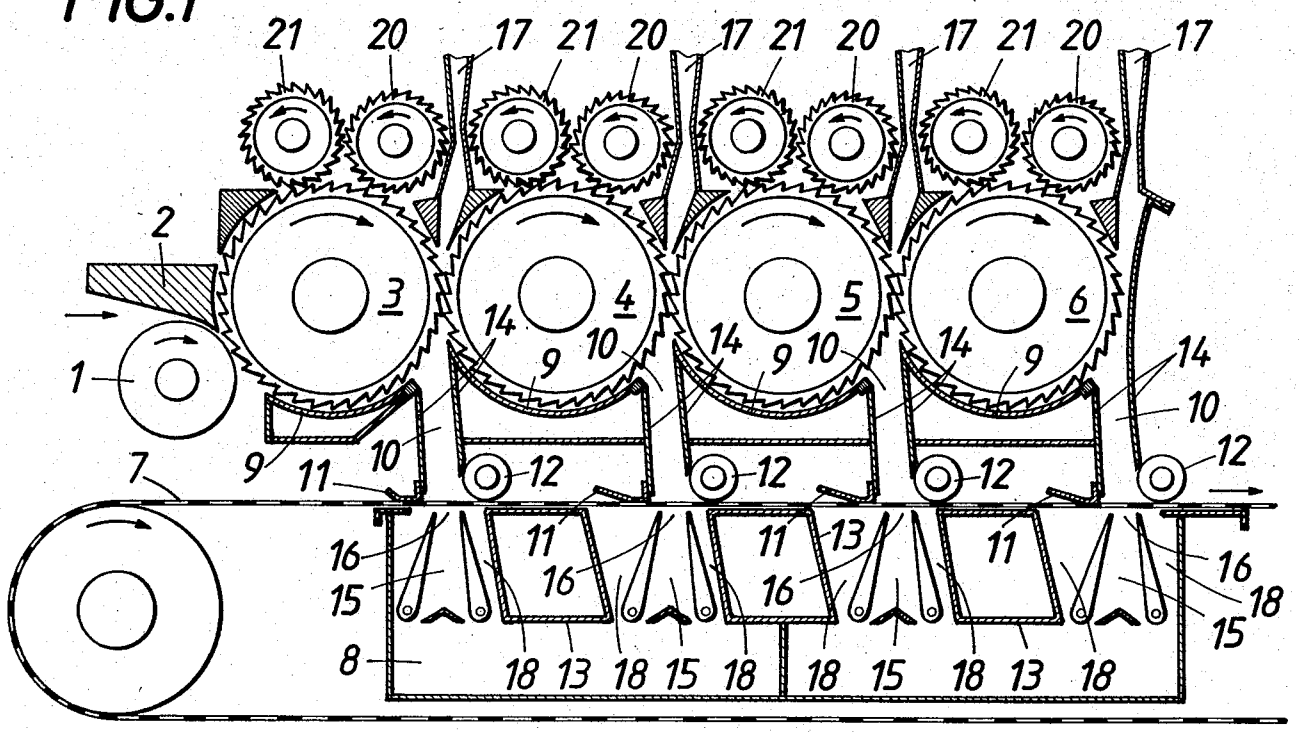
FIG. 1 is a diagrammatic vertical sectional view showing apparatus according to the invention for making a fibrous web and FIG. 2 is a view that is similar to FIG. 1 and shows on a larger scale that portion of the apparatus that is adjacent to the discharge passages.

The invention is illustrated by way of example on the drawing.

The illustrated apparatus comprises a feeder for a feed web. That feeder comprises a feed roller 1 and a trough-defining table 2. The apparatus comprises also consecutive and closely spaced apart carding drums 3, 4, 5, and 6, which rotate in the same sense, and a collecting surface 7, which is spaced below the carding drums and is constituted by an air-permeable revolving conveyor belt 6. Air can be sucked from the collecting surface by means of a suction box 8. In order to assist the formation of a suitable suction air stream from the carding drums 3, 4, 5, 6 through the collecting surface 7, each carding drum is provided on the side that is opposite to the collecting surface 7 with a covering 9. Discharge passages 10 are provided between the coverings 9 and extend into the triangular spaces which are defined between adjacent ones of the carding drums 3, 4, 5 and 6 on the side facing the collecting surface 7. On that side on which each discharge passage 10 is approached by the collecting surface 7, each discharge passage 10 is sealed to the conveyor belt 7 by means of a guide wall 11 for the previously deposited web layer. On the side on which the collecting surface departs, each discharge passage is sealed to the conveyor belt 7 by a roller 12, which rolls on the web layer. As a result, the discharge passages 10 are sealed from disturbing influences of lateral air streams adjacent to the collecting surface 7. Because substantially no air is sucked from the collecting surface 7 in the regions between the discharge passages 10 owing to the provision of inserts 13 in said regions, the web layer will not be disturbed by air vortices outside the discharge passages 10.

To ensure that the fibers which have been thrown off cannot impinge on an air cushion, which would promote a formation of clumps, and that such fibers will not be subjected to disturbing influences by the passage-defining walls 14, each discharge passage 10 has associated with it a suction nozzle 15, which is disposed under the collecting surface 7 and connected to the suction box 8 and has an inlet opening 16, which is laterally spaced from both passage-defining walls 14 within the region of the mouth of the discharge passage 10. As a result, the entraining air stream sucked by the suction nozzle 15 will be confined in such a manner that the fibers are entrained toward the collecting surface 7 adjacent to the inlet opening 16 of the suction nozzle 15 and will be kept at a distance from the passage-defining walls 14. The velocity of flow at which said fibers are entrained in a given discharge passage will be selected in consideration of the surface speed of that carding drum which throws fibers into that discharge passage. Air at the rate required to form the entraining air stream between two adjacent carding drums is sucked through air passages 17 provided between the carding drums.

To ensure that individual fibers previously deposited on the collecting surface 7 will not be dislocated outside the inlet opening 16 of the suction nozzle 15, a vacuum is applied to the collecting surface 7 through the passages 18 which are defined by the inserts 13 and the suction nozzles 15. That vacuum is just sufficient to retain the fibers on the collecting surface 7 but will not have a disturbing influence in the associated discharge passage 10. For an adjustment of the vacuum in the passages 18 to existing conditions, the passages 18 may be connected to the suction box 8 by means of gate valves 19 shown in FIG. 2.

Figure 2:
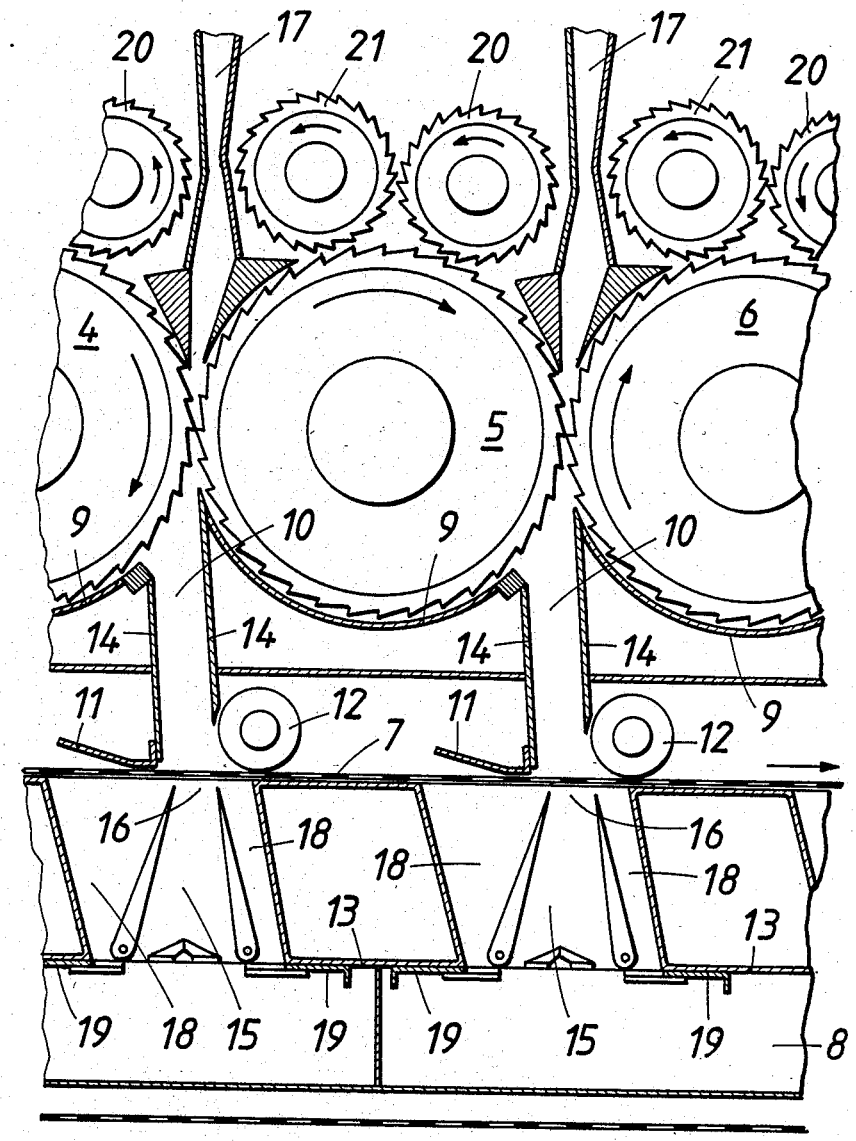

To ensure the desired action of the suction nozzles 15, the zones to which the vacuum is applied should extend at least substantially throughout the width of the zone in which fibers are received by the collecting surface. For the function it is not significant whether the area to which a vacuum is applied in order to suck the entraining air stream is constituted by one suction nozzle or by a plurality of suction nozzles. As is indicated in FIG. 2 the side walls of the suction nozzles 15 may be pivotally movable relative to each other for an adaptation of the width of the suction zone to the existing requirements.

Because the carding drums 3, 4, 5, and 6 closely succeed each other, each succeeding carding drum constitutes a worker roller for the preceding carding drum. As a result, the feed web which is delivered to the carding drum 3 by the feeder is partly combed out by the carding drum 4, which rotates in the same sense. That fibrous material which is not removed by the carding drum 4 is thrown off into the discharge passage 10 between the carding drums 3 and 4 and is thus deposited on the collecting surface 7. That fibrous material which is forwarded by the carding drum 4 is divided also adjacent to the carding drum 5 into a partial stream which is to be thrown off and a partial stream which is to be forwarded. The latter partial stream is divided by an additional combing operation also adjacent to the carding drum 6.

In order to improve the opening of the feed web, each of the carding drums 3, 4, 5, and 6 has associated with it an additional worker roller 20 and a clearer roller 21 on that side which is remote from the collecting surface 7. The worker roller 20 combs out part of the fibers which cover each carding drum, and the fibrous material which has been taken by the worker roller 20 is taken over and returned to the same carding drum by the clearer roller 21. As a result, the fibrous material covering each carding drum is opened before it is delivered to the succeeding carding drum and that opening is accompanied by an equalization of any irregularities in the distribution of fibers so that the total opening capacity of the apparatus can be considerably increased.

I claim:

1. Apparatus for making a fibrous web comprising a feeder for receiving a feed web, a plurality of serrated carding drums rotating in the same sense at a surface speed which permits the fibers on the drums to fly from the latter under centrifugal force, and an air-permeable collecting surface, which is continually moved and from which air is sucked, and wherein fibers of the preliminary web fly from the carding drums in respective partial streams, which impinge on the collecting surface at points spaced apart in the direction of travel of the collecting surface, the carding drums are arranged one behind the other in the direction of movement of the feed web and are closely spaced apart, and each carding drum which succeeds another in the direction of travel of the feed web constitutes a worker roller associated with the preceding carding drum, characterized in that each of the closely succeeding carding drums has associated with it an additional worker roller and a clearer roller, which are disposed adjacent to that half of the periphery of the drum that is remote from the collecting surface.

2. Apparatus according to claim 1, characterized in that said discharge passages are defined adjacent to the collecting surface by a guide wall, which is disposed on the side on which the collecting surface approaches the discharge passage, which guide wall serves to guide the previously formed web layer, and by a roller rolling on the web layer on that side on which the collecting surface departs from the discharge passage.

3. Apparatus according to claim 2, characterized in that the guide wall is adapted to be resiliently urged against the web layer on the collecting surface.

4. Apparatus according to claim 1, characterized in that the guide wall and the collecting surface define between them an entrance gap for the previously deposited web layer, which entrance gap tapers in the direction of movement of the collecting surface.

5. Apparatus according to claim 1, characterized in that a suction nozzle directed toward the discharge passage is disposed under the collecting surface in the region between the two walls of each discharge passage and said nozzle has an inlet opening which is laterally spaced from both walls of the discharge passage within the region of the mouth of the discharge passage.

6. Apparatus according to claim 5, characterized in that a vacuum is applied to the collecting surface on that side which is remote from the discharge passages also outside the suction nozzle, at least adjacent to the mouth of each discharge passage, so that the deposited fibers will be retained on the collecting surface.

* * * * *